US005927432A

United States Patent [19]

Hershtik

[11] Patent Number: 5,927,432

[45] Date of Patent: Jul. 27, 1999

[54] RESCUE APPARATUS

[76] Inventor: Arie Hershtik, 24 Hagevura Hayehudit Street, Rishon le Zion 75281, Israel

[21] Appl. No.: 09/004,570

[22] Filed: Jan. 8, 1998

[30] Foreign Application Priority Data

Oct. 28, 1997 [IL] Israel ..... 122059

[51] Int. Cl.[6] ..... E04G 3/00

[52] U.S. Cl. ..... 182/82; 182/37; 182/141; 187/239

[58] Field of Search ..... 182/82, 141, 43, 182/142, 37; 254/391, 411, 390, 286, 338; 187/239, 266; 384/55, 58

[56] References Cited

U.S. PATENT DOCUMENTS

| | | | |
|---|---|---|---|
| 745,915 | 12/1903 | Scully . | |
| 780,711 | 1/1905 | Donnell | 182/141 |
| 1,138,902 | 5/1915 | Smith . | |
| 2,228,042 | 1/1941 | Zanger | 182/142 X |
| 2,618,361 | 11/1952 | Zindt . | |
| 3,517,774 | 6/1970 | Meyer | 187/239 |
| 4,018,306 | 4/1977 | Lyons . | |
| 4,315,456 | 2/1982 | Hayashi et al. . | |
| 4,386,680 | 6/1983 | Reed | 182/142 X |
| 4,406,351 | 9/1983 | Littlejohn et al. | 182/142 X |
| 4,469,198 | 9/1984 | Crump | 182/82 X |
| 4,640,384 | 2/1987 | Kucher et al. | 182/51 |
| 4,767,101 | 8/1988 | Schweinberger | 182/43 X |

*Primary Examiner*—Daniel P. Stodola
*Assistant Examiner*—Hugh B. Thompson
*Attorney, Agent, or Firm*—Welsh & Katz, Ltd.

[57] ABSTRACT

Rescue apparatus including a track mounted vertically on an outside surface of a building, a pulley mounted on the building above the track, a non-rescue-grade guide cable arranged for moving along the track, an upper end of the guide cable engaging the pulley, and release apparatus for arresting downward movement of the upper end of the guide cable and for selectively releasing the upper end of the guide cable so as to permit downward movement of the upper end of the guide cable.

21 Claims, 7 Drawing Sheets

30
32
12
80
78
76
34
76
46
30
50
38
44
48
TO WINCH 28
30
50
52

RESCUE APPARATUS

FIELD OF THE INVENTION

The present invention relates generally to rescue apparatus, and particularly to an outside rescue elevator system for high-rise buildings using a removable non-rescue-grade cable which is replaced with a rescue-grade cable when actually required to rescue people.

BACKGROUND OF THE INVENTION

Outside rescue elevators are known in the art. U.S. Pat. Nos. 745,915 to Scully, 780,711 to Donnell, 1,138,902 to Smith, 2,618,361 to Zindt, 3,517,774 to Meyer, 4,018,306 to Lyons and 4,315,456 to Hayashi et al., all describe various rescue elevators and related apparatus.

U.S. Pat. No. 4,469,198 to Crump describes an outside rescue elevator system for a high-rise building including a dual compartment track with a dual cable system and a wheeled truck (i.e., elevator cab mounting device) in one compartment. A portable elevator cab is connected to the truck. An elevator cab is provided with stabilizing wheels for riding upon a smooth vertical roadbed on the exterior surface of the building. The stabilizing wheels are horizontally adjustable to accommodate different exterior wall surfaces of different buildings.

SUMMARY OF THE INVENTION

The present invention seeks to provide improved rescue apparatus. In the present invention, a non-rescue-grade guide cable is disposed in a track attached to an outside surface of a building. Throughout the specification and claims the term "non-rescue-grade guide cable" encompasses any cable, rope, wire or the like that does not necessarily have adequate strength normally required by safety codes for supporting elevator cabs and/or persons being rescued from buildings. In contrast, the term "rescue-grade guide cable" encompasses any cable, rope, wire or the like that has at least adequate strength required by safety codes for supporting elevator cabs and/or persons being rescued from buildings.

The non-rescue-grade guide cable simplifies the construction and cost of installing the apparatus in buildings. All the actual rescue equipment including the rescue-grade guide cable is brought to the scene of an emergency by a rescue vehicle, typicaltv stored during non-emergency situations at fire stations or the like. The rescue vehicle carries with it a winch with the rescue-grade utility cable wrapped therearound, and an elevator cab. The elevator cab is designed to carry as many passengers as desired, and is sliding attached to the track by means of a pair of rollers.

There is thus provided in accordance with a preferred embodiment of the present invention rescue apparatus including a track mounted vertically on an outside surface of a building, a pulley mounted on the building above the track, a non-rescue-grade guide cable arranged for moving along the track, an upper end of the guide cable engaging the pulley, and release apparatus for arresting downward movement of the upper end of the guide cable and for selectively releasing the upper end of the guide cable so as to permit downward movement of the upper end of the guide cable.

In accordance with a preferred embodiment of the present invention the track has a passageway formed therein and the non-rescue-grade guide cable is arranged for moving inside the passageway.

Further in accordance with a preferred embodiment of the present invention the release apparatus includes a weight attached to the upper end of the guide cable and the pulley has a groove formed therein, the groove having one end open at a periphery of the pulley and a closed end inwards of the periphery of the pulley, wherein the weight includes a portion which initially rests in the closed end, wherein pulling the guide cable generally downwards causes the portion to move in the groove past the open end, thereby causing the weight to be released from the pulley and to move downwards.

Still further in accordance with a preferred embodiment of the present invention the rescue apparatus includes a rescue-grade utility cable attached to a lower end of the guide cable.

Additionally in accordance with a preferred embodiment of the present invention wherein releasing of the weight from the pulley causes the guide cable to pass around and move off the pulley and the utility cable to be fed around the pulley in place of the guide cable.

In accordance with a preferred embodiment of the present invention the rescue apparatus includes a winch from which the utility cable is spooled.

Further in accordance with a preferred embodiment of the present invention the rescue apparatus includes a guide pulley pivotally attached to a lower end of the track.

Still further in accordance with a preferred embodiment of the present invention the guide pulley permits feeding the utility cable from the winch to the track within an azimuthal angle in a range of 0° to at least 180° relative to the track.

Additionally in accordance with a preferred embodiment of the present invention the winch is mounted on a rescue vehicle.

In accordance with a preferred embodiment of the present invention the track has a cross-sectional shape of a parallelogram. Preferably an edge of the parallelogram faces the outside surface of the building. Preferably the parallelogram is a rhombus.

Further in accordance with a preferred embodiment of the present invention the track includes a first plate extending from the edge of the parallelogram that faces the outside surface of the building, the plate being attached to the building.

Still further in accordance with a preferred embodiment of the present invention the track includes a second plate extending from an edge of the parallelogram opposite the edge of the parallelogram that faces the outside surface of the building.

Additionally in accordance with a preferred embodiment of the present invention the parallelogram and the first and the second plates are formed by welding a first track member and a second track member together, the first track member including as one unitary piece the first plate and two faces of the parallelogram, and the second track member including as one unitary piece the second plate and the two remaining faces of the parallelogram opposite to the faces of the first track member, wherein a first lip extends from one of the faces of the parallelogram of the first track member and abuts against a recess formed at a junction of the second plate and a corresponding one of the faces of the parallelogram of the second track member, and a second lip extends from one of the faces of the parallelogram of the second track member and abuts against a recess formed at a junction of the first plate and a corresponding one of the faces of the parallelogram of the first track member.

In accordance with a preferred embodiment of the present invention the rescue apparatus includes an elevator cab attached to the utility cable.

Further in accordance with a preferred embodiment of the present invention the elevator cab includes a pair of rollers which roll along opposing sides of the track. Preferably the rollers are pivotally attached to the elevator cab.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 1:
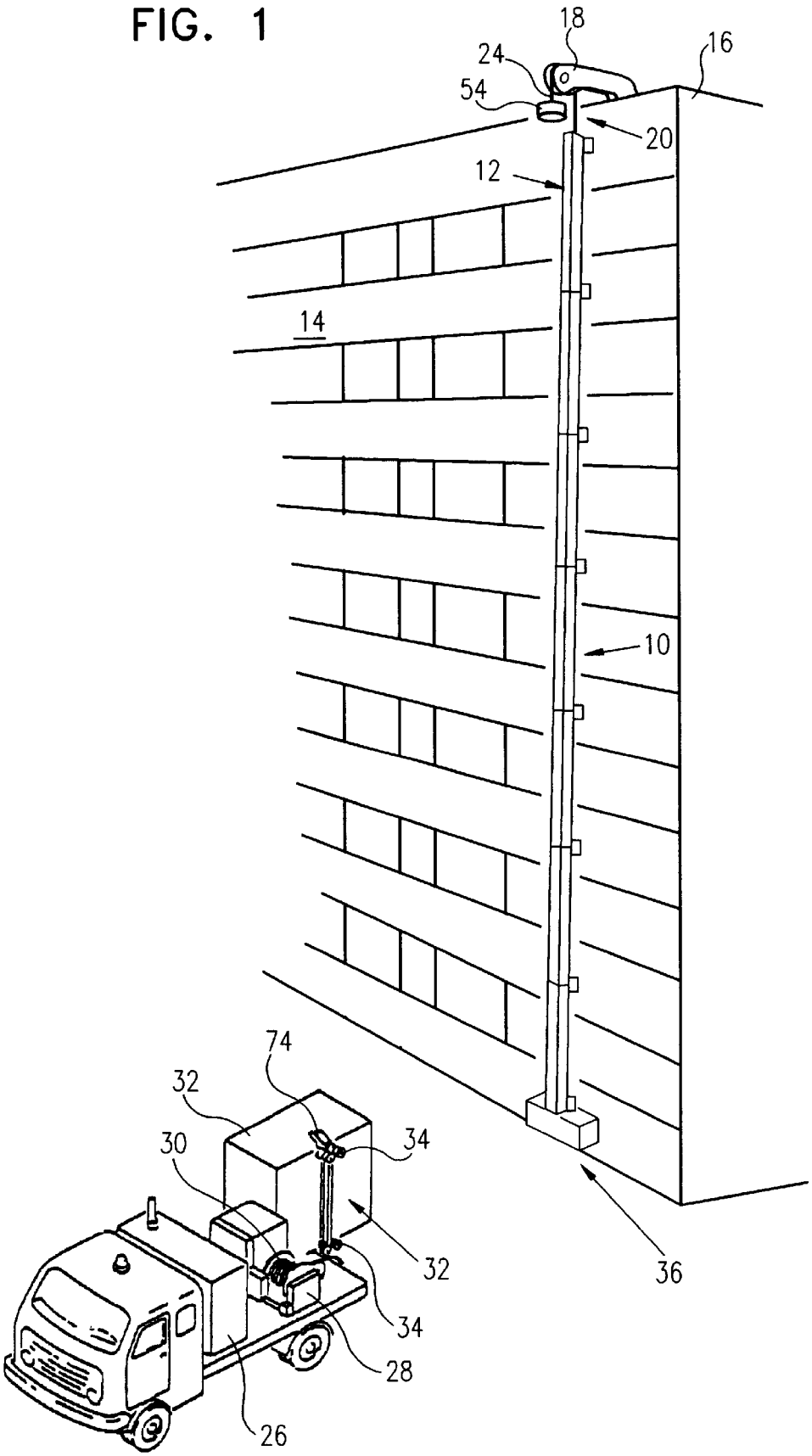
FIG. 1 is a simplified pictorial illustration of rescue apparatus, including a track and a non-rescue-grade guide cable, constructed and operative in accordance with a preferred embodiment of the present invention, prior to attaching a rescue-grade utility cable to the non-rescue-grade guide cable.

Reference is now made to FIG. 1 which illustrates rescue apparatus 10 constructed and operative in accordance with a preferred embodiment of the present invention.

Rescue apparatus 10 preferably includes a track 12 mounted vertically on an outside surface 14 of a building 16. Track 12 may have any arbitrary cross-sectional shape. For the sake of simplicity, track 12 is illustrated as having a rectangular cross section in FIGS. 1–6, but a preferred cross section is described hereinbelow with reference to FIGS. 7 and 8. A pulley 18 is mounted on the building 16 above track 12, and a non-rescue-grade guide cable 20 is arranged for moving along track 12. Preferably, as shown later in FIG. 7, track 12 has a passageway 22 formed therein and guide cable 20 is arranged for moving inside passageway 22. This arrangement is preferred so as to protect guide cable 20 from the environment and from tampering therewith. Referring again to FIG. 1, it is seen that an upper end 24 of guide cable 20 is fed around pulley 18.

In the event of an emergency need for rescuing people from building 16, a rescue vehicle 26 is brought to the scene. Rescue vehicle 26 is typically stored during non-emergency situations at fire stations or the like. Rescue vehicle 26 carries with it a winch 28 with a rescue-grade utility cable 30 wrapped therearound, and an elevator cab 32. Elevator cab 32 is designed to carry as many passengers as desired, and is sliding attached to track 12 by means of a pair of rollers 34 (preferably an upper pair and a lower pair of rollers 34) as will described hereinbelow. A box 36 preferably conceals a lower end of track 12 during non-emergency situations.

Figure 2:
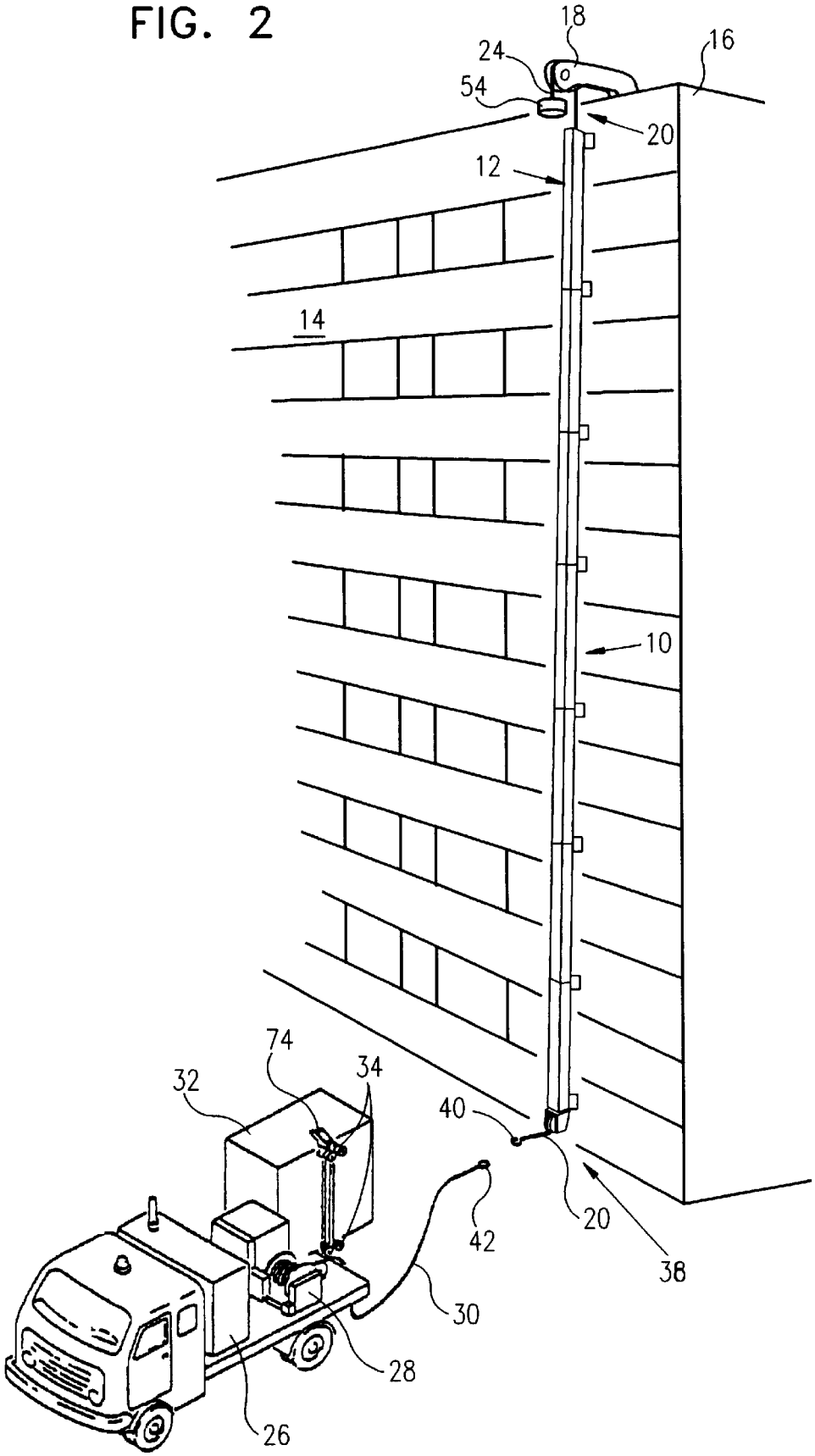
FIG. 2 is a simplified pictorial illustration of attaching the rescue-grade utility cable to the non-rescue-grade guide cable of the rescue apparatus of FIG. 1.

Reference is now made to FIG. 2 which illustrates attaching utility cable 30 to guide cable 20. Firstly, box 36 is removed to expose the lower end of track 12. A guide pulley 38 is attached to the lower end of track 12, guide pulley 38 being described hereinbelow with reference to FIG. 3. Suitable mating connectors 40 and 42 may be provided at ends of guide cable 20 and utility cable 30, respectively, for quickly and reliable attaching the two cables together.

Figure 3:
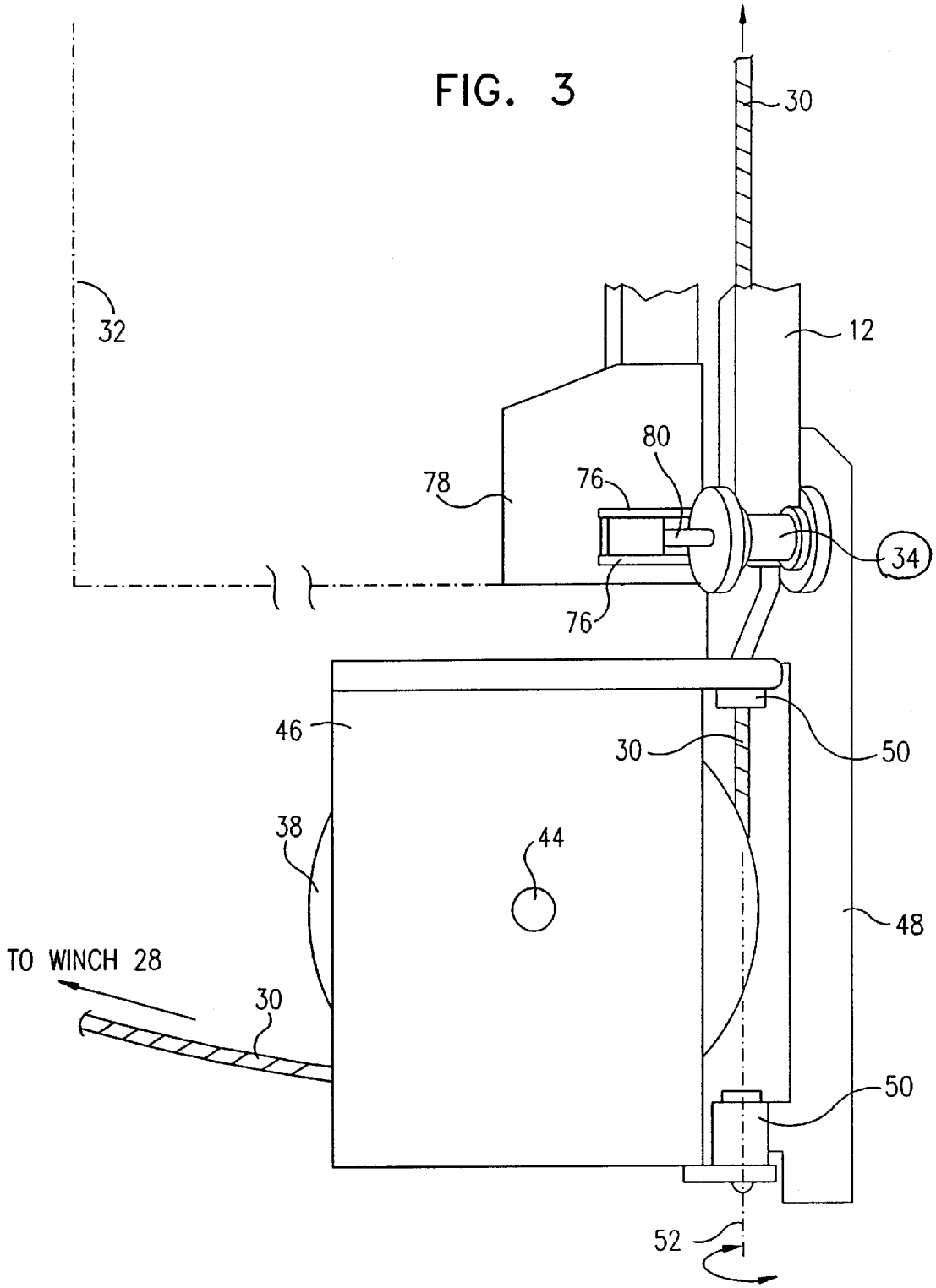
FIG. 3 is a simplified pictorial illustration of a guide pulley attached to a lower end of the track of the rescue apparatus of FIG. 1.
Figure 4:
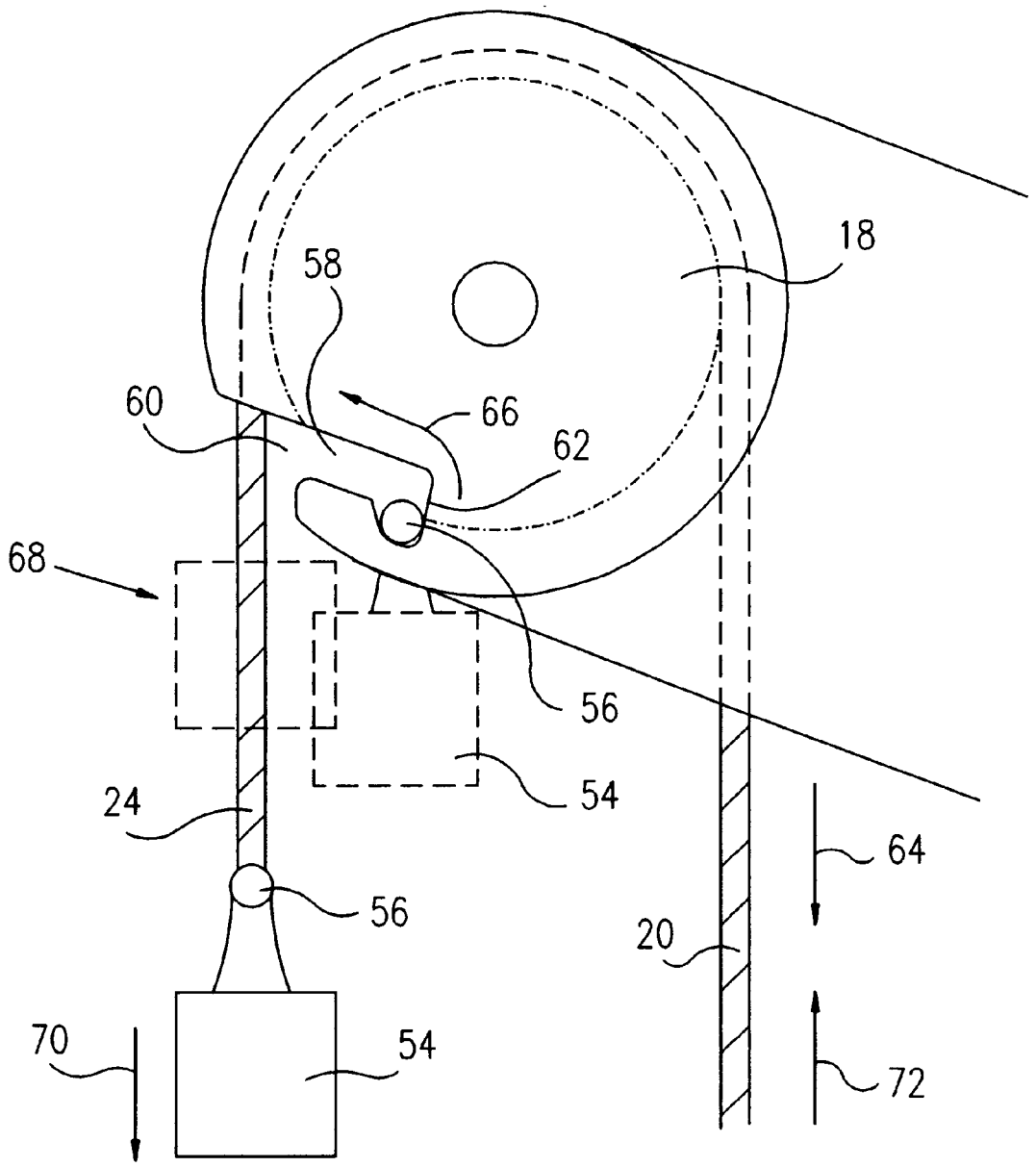
FIG. 4 is a simplified pictorial illustration of releasing the non-rescue-grade guide cable from a pulley of the rescue apparatus of FIG. 1.

Reference is now made to FIG. 3 which illustrates guide pulley 38 in further detail. Guide pulley 38 is preferably mounted on an axle 44 in a housing 46 which is pivotally attached to a lower extension 48 of track 12 about pivots 50. As seen in FIG. 3, utility cable 30, after having been connected to guide cable 20, may be fed around guide pulley 38 through the upper pivot 50 into track 12 towards pulley 18. (FIG. 3 shows utility cable 30 already fed into track 12.) Guide pulley 38 rotates about an azimuthal axis 52 defined by pivots 50. Thus, guide pulley 38 permits feeding utility cable 30 from winch 28 to track 12 within an azimuthal angle in a range of 0° to at least 180° relative to track 12.

Once utility cable 30 is attached to guide cable 20, guide cable 20 must be released from pulley 18 to permit feeding utility cable 30 up to and around pulley 18 (before reaching the configuration shown in FIG. 3 wherein utility cable 30 has already been fed into track 12.) For achieving this purpose, release apparatus is provided for arresting downward movement of upper end 24 of guide cable 20 and for selectively releasing upper end 24 of guide cable 20 so as to permit downward movement of upper end 24, as is now described with particular reference to FIG. 4.

The release apparatus preferably includes a weight 54 attached to upper end 24 of guide cable 20. A portion of weight 54, such as an upper hook element 56, initially rests in a groove 58 formed in pulley 18. Groove 58 has an end 60 open at a periphery of pulley 18 and a closed end 62 inwards of the periphery of pulley 18. As long as guide cable 20 is not disturbed, weight 54 remains in groove 58 at closed end 62 and thus remains suspended in the air near the top of building 16 (FIG. 1). By pulling guide cable 20 generally downwards in the direction of an arrow 64, upper hook element 56 is caused to move in groove 58 as indicated by an arrow 66. Upper hook element 56 eventually moves past open end 60 to the position indicated by reference numeral 68. At this position, weight 54 is released from pulley 18 and is free to move downwards in the direction of an arrow 70. The rest of guide cable 20 on the right side of pulley 18, in the sense of FIG. 4, moves in the direction of an arrow 72. Weight 54 may fall freely or have its descending velocity controlled in any suitable manner.

Figure 5:
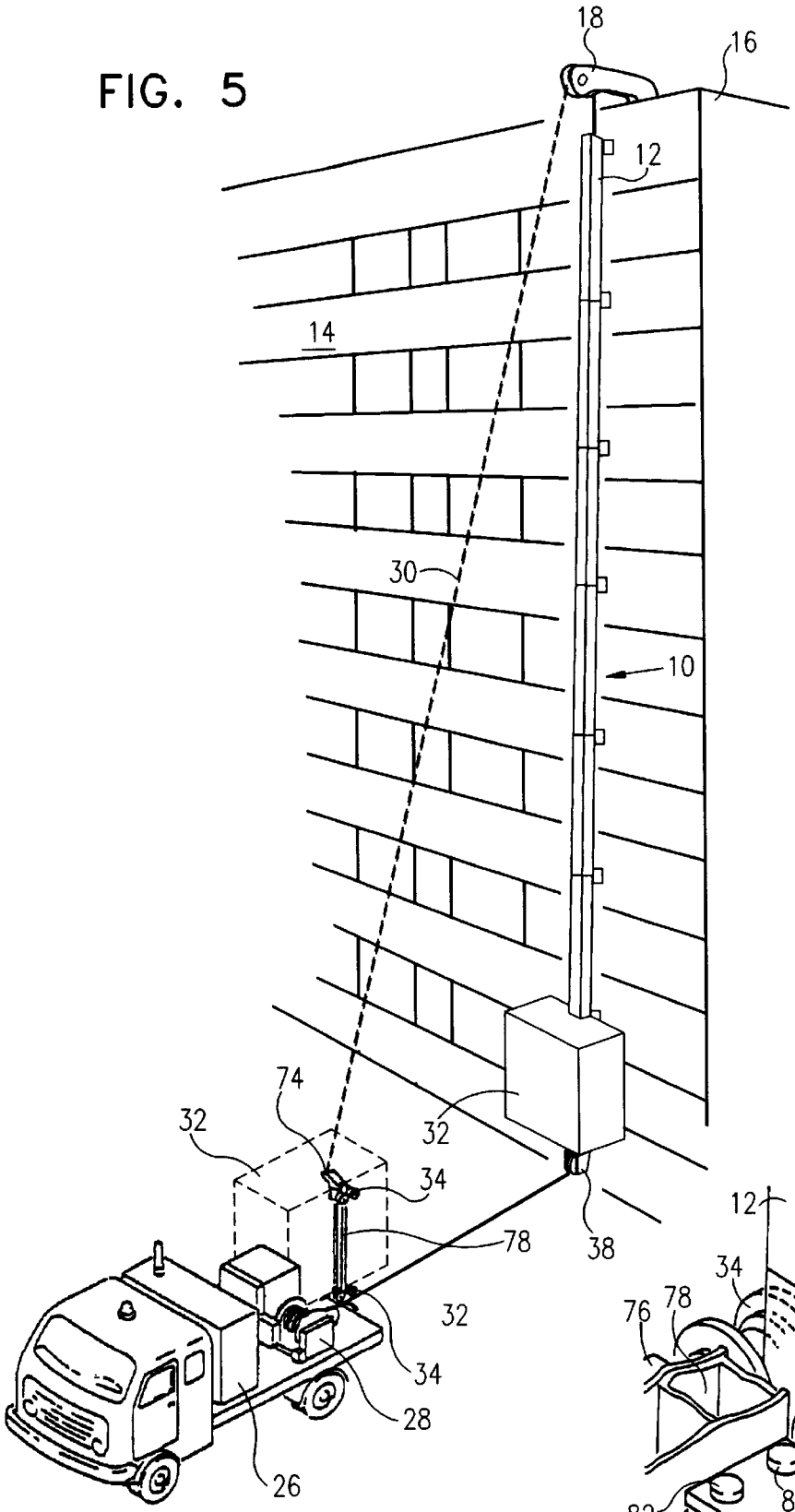
FIG. 5 is a simplified pictorial illustration of attaching an elevator cab from a rescue vehicle to the track of the rescue apparatus of FIG. 1.

Reference is now made to FIG. 5 which illustrates utility cable 30 after having been spooled from winch 28 and fed around pulley 18. Utility cable 30 is then attached to an attachment lug 74 on elevator cab 32. Elevator cab 32 may then be lifted (by actuating winch 28) and brought into engagement with track 12.

Figure 6:
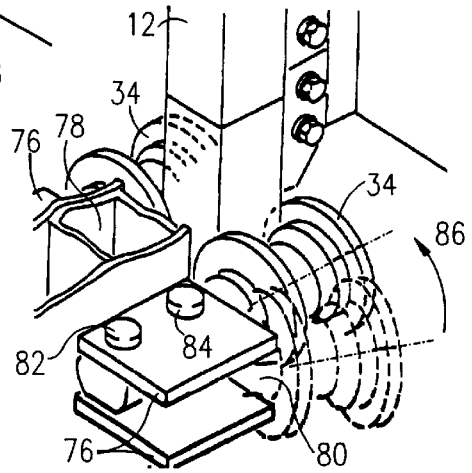
FIG. 6 is a simplified, close-up, pictorial illustration of engaging rollers of the elevator cab with the track.

Reference is now additionally made to FIG. 6. It is seen that each roller 34 is preferably pivotally attached to a pair of flanges 76 jutting from a beam 78 attached to elevator cab 32. Each roller 34 is preferably mounted on a shaft 80 which is pinned to flange 76 by a pair of pins 82 and 84. Initially, when attaching elevator cab 32 to track 12, one of the rollers 34 is fully pinned by both pins 82 and 84, while the other roller 34 is only pinned by pin 82. Thus, the latter roller 34 is free to rotate about pin 82 as indicated by an arrow 86 in FIG. 6. This roller 34 is then simply rotated about pin 82 until it abuts against track 12, whereupon pin 84 is then assembled to fix roller 34 in place. This arrangement allows for easy installment of elevator cab 32 on track 12 without worrying about tolerances.

Once elevator cab 32 is attached to track 12, elevator cab 32 may be moved up and down track 12 by means of winch 28 to rescue people from building 16.

Figure 7:
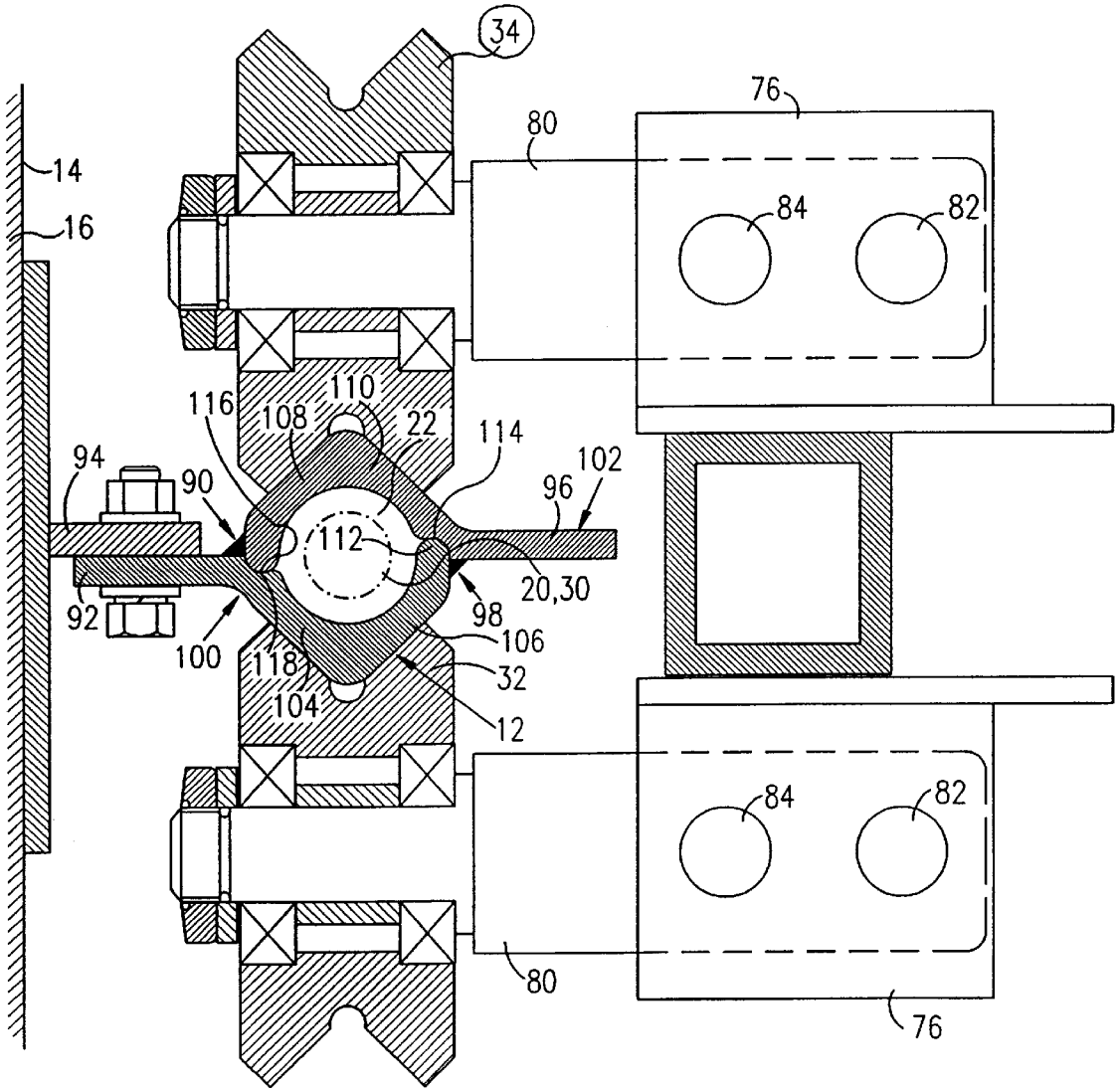
FIG. 7 is a simplified partially sectional illustration of a top-view cross-section of the track with the rollers engaged therewith, in accordance with a preferred embodiment of the present invention.
Figure 8:
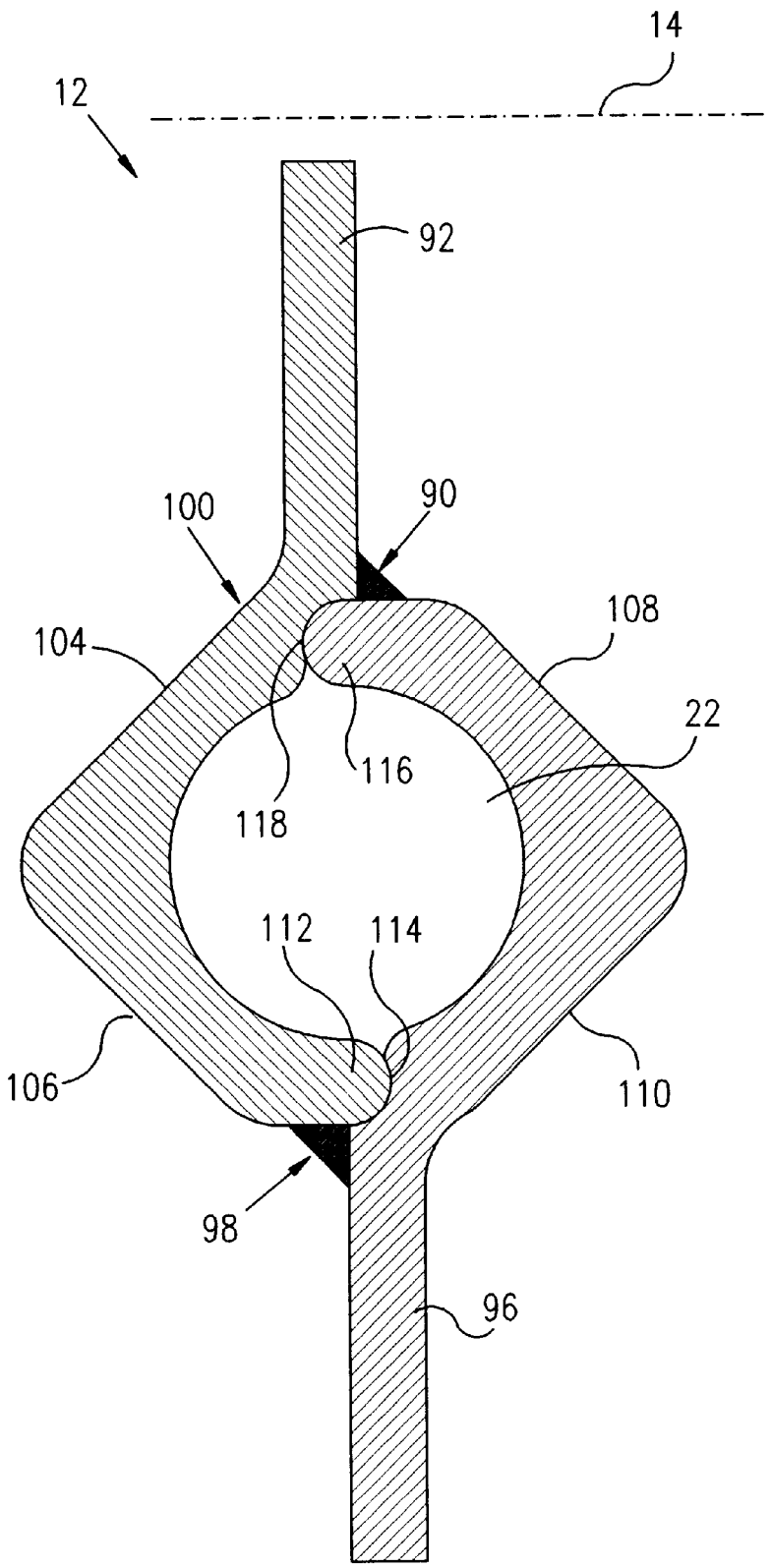
FIG. 8 is a simplified partially sectional illustration of a top-view cross-section of the track, which more clearly illustrates the track than FIG. 7.

Reference is now made to FIGS. 7 and 8 which illustrate a top-view cross-section of track 12 in accordance with a preferred embodiment of the present invention. Track 12 preferably has a cross-sectional shape of a parallelogram wherein an edge 90 of the parallelogram faces surface 14 of building 16. The parallelogram may have unequal sides, but most preferably is a rhombus.

In accordance with a preferred embodiment of the present invention, a first plate 92 extends from edge 90 and is attached to building 16, such as by means of a welded flange 94. A second plate 96 preferably extends from an edge 98 of the parallelogram opposite edge 90. Preferably plates 92 and 96 are formed by welding a first track member 100 and a second track member 102 together at edges 90 and 98. First track member 100 comprises as one unitary piece first plate 92 and two faces 104 and 106 of the parallelogram. Second track member 102 comprises as one unitary piece second plate 96 and the two remaining, faces 108 and 110 of the parallelogram opposite to faces 104 and 106. A first lip 112 preferably extends from face 106 and abuts against a recess 114 formed at a junction of second plate 96 and face 110. A second lip 116 preferably extends from face 108 and abuts against a recess 118 formed at a junction of first plate 92 and face 104.

The unique shape and construction of track 12 permits moving elevator cab 32 on a single, strong, sturdy track that withstands wind and other environmental forces.

If desired, elevator cab 32 may ride on plate 96 instead of faces 104, 106, 108 and 110.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. Rescue system comprising:

a track vertically mountable on an outside surface of a building;

a pulley mountable above said track, said pulley having a first and second groove said second groove having one end open at a periphery of said pulley and a closed end inwards of the periphery of said pulley;

a guide cable arranged for moving along said track, an upper end of said guide cable being at least partially wrapped around said first groove of said pulley; and release apparatus comprising a weight attached to said upper end of said guide cable, said weight comprising a portion which initially rests in said closed end of said second groove, wherein pulling said guide cable generally downwards causes said portion to move in said second groove past said open end, thereby causing said weight to be released from said pulley and to move downwards.

2. Rescue system according to claim 1 and wherein said guide cable comprises a non-rescue-grade guide cable.

3. Rescue system according to claim 1 or claim 2 and wherein said track has a passageway formed therein and said guide cable is arranged for moving inside said passageway.

4. Rescue system according to claim 1 or claim 2 further comprising a rescue-grade utility cable attached to a lower end of said guide cable.

5. Rescue system according to claim 4 wherein releasing of said weight from said pulley causes said guide cable to move off said pulley and said utility cable to be fed around said pulley in place of said guide cable.

6. Rescue system according to claim 4 and comprising a winch from which said utility cable is spooled.

7. Rescue system according to claim 6 and comprising a guide pulley pivotally attached to a lower end of said track.

8. Rescue system according to claim 6 further comprising a rescue vehicle wherein said winch is mounted on said rescue vehicle.

9. Rescue system according to claim 4 and comprising an elevator cab attached said utility cable.

10. Rescue system according to claim 9 and wherein said elevator cab comprises a pair of rollers which roll along opposing sides of said track.

11. Rescue apparatus according to claim 10 and wherein said rollers are pivotally attached to said elevator cab.

12. Rescue system according to claim 1 or claim 2 wherein said track has a cross-sectional shape of a parallelogram.

13. Rescue system according to claim 12 wherein said parallelogram is a rhombus.

14. Rescue system according to claim 12 further comprising a building, said track being mounted on an outside surface of said building, and wherein an edge of said parallelogram faces said outside surface of said building.

15. Rescue system according to claim 14 and wherein said track comprises a first plate extending from said edge of said parallelogram that faces said outside surface of said building, said plate being attached to said building.

16. Rescue system according to claim 15 and wherein said track comprises a second plate extending from an edge of said parallelogram opposite said edge of said parallelogram that faces said outside surface of said building.

17. Rescue system according to claim 16 and wherein said parallelogram and said first and said second plates are formed by welding a first track member and a second track member together, said first track member comprising as one unitary piece said first plate and two faces of said parallelogram, and said second track member comprising as one unitary piece said second plate and the two remaining faces of said parallelogram opposite to the faces of the first track member, wherein a first lip extends from one of the faces of said parallelogram of said first track member and abuts against a recess formed at a junction of said second plate and a corresponding one of said faces, of said parallelogram of said second track member, and a second lip extends from one of the faces of said parallelogram of said second track member and abuts against a recess formed at a junction of said first plate and a corresponding one of said faces of said parallelogram of said first track member.

18. Rescue system according to claim 1 further comprising:

a track having a cross-sectional shape of a parallelogram;

a first plate extending outwards from a first edge of said parallelogram; and a second plate extending outwards from a second edge of said parallelogram opposite to said first edge, said first plate and said second plate being generally coplanar.

19. Rescue system according to claim 18, wherein said parallelogram comprises a rhombus.

20. Rescue system according to claim 18, farther comprising a building with an outside surface, said track being mounted on said outside surface with said first plate generally perpendicular to said outside surface of said building.

21. Rescue system according to claim 18, wherein said first and said second plates are formed by welding a first track member and a second track member together, said first track member comprising as one unitary piece said first plate and two faces of said parallelogram, and said second track member comprising as one unitary piece said second plate and the two remaining faces of said parallelogram opposite to the faces of the first track member, wherein a first lip extends from one of the faces of said parallelogram of said first track member and abuts against a recess formed at a junction of said second plate and a corresponding one of said faces of said parallelogram of said second track member, and a second lip extends from one of the faces of said parallelogram of said second track member and abuts against a recess formed at a junction of said first plate and a corresponding one of said faces of said parallelogram of said first track member.

* * * * *